US010549871B2

(12) United States Patent
Cerf

(10) Patent No.: US 10,549,871 B2
(45) Date of Patent: Feb. 4, 2020

(54) FILM WRAPPING USING A SINGLE ROLL

(71) Applicant: Alain Cerf, Pinellas Park, FL (US)

(72) Inventor: Alain Cerf, Pinellas Park, FL (US)

( * ) Notice: Subject to any disclaimer, the term of this patent is extended or adjusted under 35 U.S.C. 154(b) by 1510 days.

(21) Appl. No.: 14/070,519

(22) Filed: Nov. 2, 2013

(65) Prior Publication Data

US 2015/0121812 A1 May 7, 2015

(51) Int. Cl.
*B65B 41/18* (2006.01)

(52) U.S. Cl.
CPC ..... *B65B 41/18* (2013.01)

(58) Field of Classification Search
CPC ..... B65B 41/00; B65B 41/08; B65B 41/18; B65B 9/00; B65B 9/026; B65B 9/073; B65B 13/18; B65B 13/04
USPC ..... 53/442, 66, 389.4
See application file for complete search history.

(56) References Cited

U.S. PATENT DOCUMENTS 3,815,313 A * 6/1974 Heisler ..... B65B 9/026 53/413
3,946,539 A * 3/1976 Noack ..... B29C 66/0342 53/374.8
3,955,339 A * 5/1976 Kiener ..... B65B 9/02 53/228
4,315,394 A * 2/1982 Noack ..... B65B 13/22 53/229
4,514,963 A * 5/1985 Bruno ..... B65B 9/06 198/460.1
4,662,148 A * 5/1987 Nilsson ..... B65B 11/10 53/228
4,909,018 A * 3/1990 Yamamoto ..... B65B 57/02 53/450
4,991,376 A * 2/1991 Backman ..... B65B 25/14 53/389.2
5,221,058 A * 6/1993 Fillis ..... B65B 41/18 226/29
5,412,923 A * 5/1995 Lashyro ..... B65B 9/13 53/397
5,566,526 A * 10/1996 Suga ..... B65B 9/067 53/389.4
5,653,085 A * 8/1997 Suga ..... B29C 66/961 53/374.5
6,282,868 B1 * 9/2001 Vlaam ..... B65B 11/10 53/228
6,454,689 B1 * 9/2002 Voss ..... B31B 19/10 493/11
6,761,014 B2 * 7/2004 Cerf ..... B65B 11/10 53/209

(Continued)

*Primary Examiner* — Chelsea E Stinson
(74) *Attorney, Agent, or Firm* — Sam Silverberg

(57) ABSTRACT

This invention is to register printed film on product while wrapping the printed film from a single roll. This is achieved by using a sensor that can read a mark on the film in order to insure that a predetermined length of film is pulled off the roll and the printed portion of the film is in registration with the product. The marks on the film establish the amount of film needed to wrap the product. A sensor such as a photo sensor reads the mark and determines whether the proper length of the film has been pulled off the roll. When the amount of film pulled of the roll does not coincided with sensor reading, the distance between where the product stops and the sealing bar is varied. This allows the length of the film to be adjusted until the sensor readings and the length of the film coincides.

11 Claims, 3 Drawing Sheets

(56) References Cited

U.S. PATENT DOCUMENTS

| | | | | |
|---|---|---|---|---|
| 9,061,783 | B2 * | 6/2015 | Koenigkramer | B65B 9/2028 |
| 2002/0107125 | A1 * | 8/2002 | Voss | B31B 19/10<br>493/13 |
| 2004/0031242 | A1 * | 2/2004 | Cerf | B65B 11/10<br>53/442 |
| 2005/0132664 | A1 * | 6/2005 | Bettini | B26D 7/20<br>53/64 |

* cited by examiner

FILM WRAPPING USING A SINGLE ROLL

FIELD OF THE INVENTION

This invention relates to wrapping a product with heat shrinkable film by pushing the product into a curtain of film while wrapping the article from a single roll and achieving print registration.

BACKGROUND OF THE INVENTION

The prior art shows in FIG. 1 an upper roll 4 having an upper film 5 bonded to a lower film 6 on lower roll 7 to create a film curtain. The upper film is usually a short piece of film. A portion of the bonded film rests on a bucket 2 attached to conveyor 3. A product 1 is placed on the film resting on the bucket 2. The bucket 3 is pushed into a curtain of film. The upper film does not move. The lower film is pulled over product to wrap the product with the movement of the bucket conveyor.

After the film covers the product a seal bar seals the film at the back of the article. The seal bar simultaneously cuts the film and seals the film together on both sides of the cut. This creates a new curtain and seals the film wrap around the article. After sealing, the upper roll is pulled a few millimeters to allow an unsealed sealed surface for cutting and sealing the next product on the bucket conveyor. The films used in the prior art did not require print registration.

SUMMARY OF THE INVENTION

The objective of this invention is to register the printed film using the film on a single roll on the product. This is achieved by using a sensor that can read a mark on the film in order to insure that a predetermined length of film is pulled off a roll and the printed portion of the film is in registration with the product. The marks on the film establish the amount of film needed to wrap the product. A sensor such as a photo sensor reads the mark and determines whether the proper length of the film has been pulled off the roll. When the amount of film pulled of the roll does not coincided with sensor reading, the distance between where the product stops and the sealing bar is varied. This allows the length of the film to be adjusted until the sensor readings and the length of the film coincides. When the length of the film and sensor readings coincides the print will be properly registered with the product position of the product. If the sensor reads the mark too soon the product will stop closer to the sealing bar. If the sensor reading is late, the product is stopped further away from the sealing bar. After wrapping, the product is sent though a conventional heat shrinkable tunnel that heat shrinks the film.

An objective of the invention is using a pusher plate to push the product from one dead plate through the curtain of film to another dead plate. Another objective of this invention is to use a conveyor to push the product through the curtain of film onto a transfer belt

DETAILED DESCRIPTION OF THE INVENTION

Figure 1:
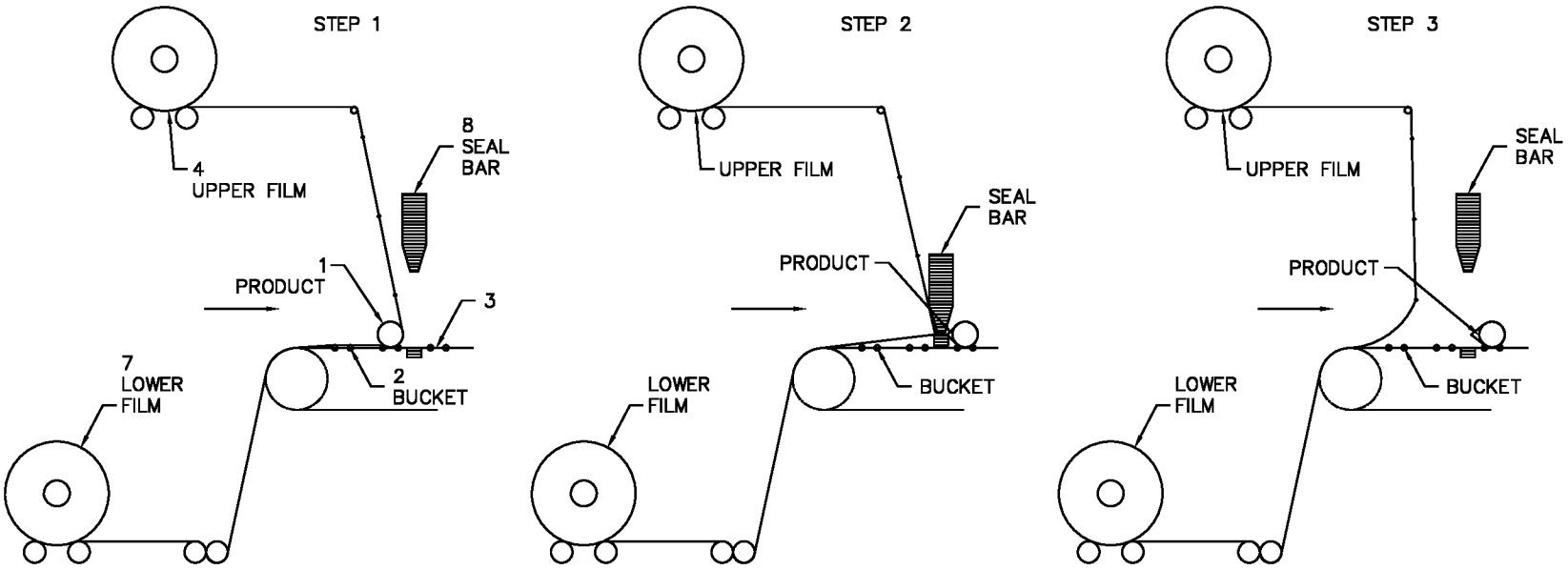
PRIOR ART FIGURE 1
FIG. 1 shows wrapping with a single roll without print registration.
Figure 3:
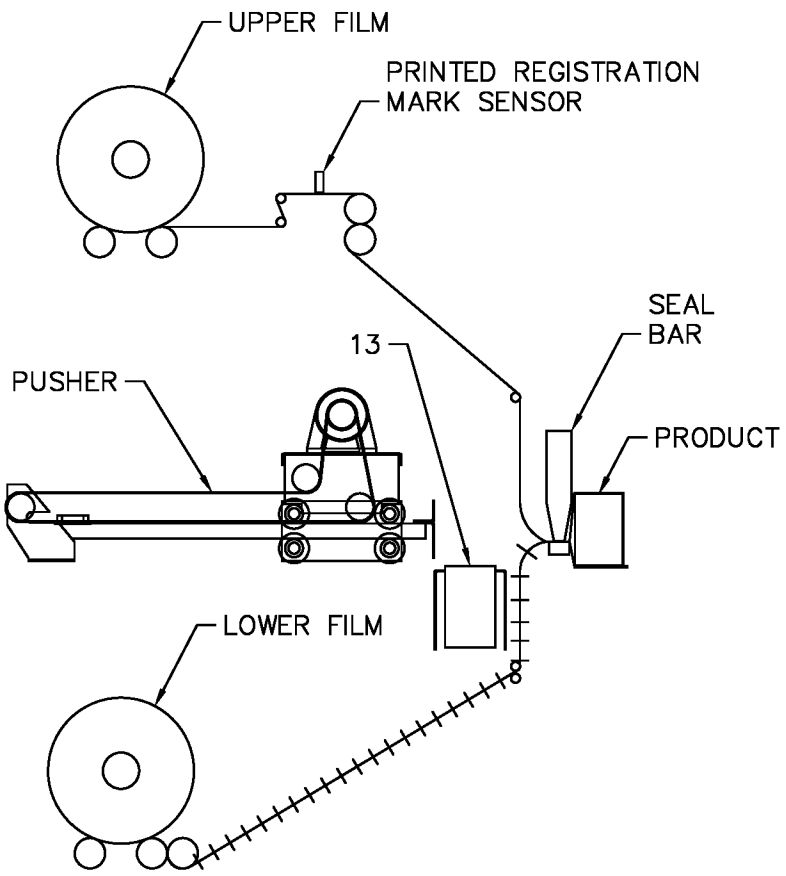
FIGS. 2 and 3 shows print registration using a pusher plate
Figure 2:
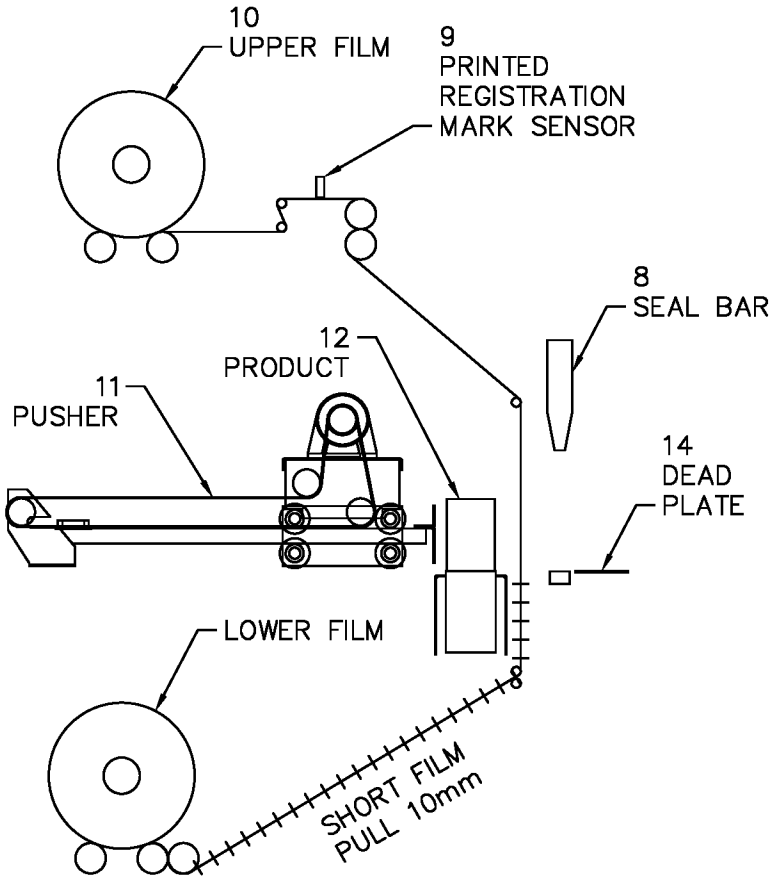

FIGS. 2 and 3 show an upper roll film 10. The lower roll film is usually has a short waste heat shrinkable film that is sealed to the upper roll film. A pusher 11 pushes the product 12 resting on dead plate 13 through the curtain onto a dead plate 14. The lower film is held in a substantially fixed position while the upper film wraps the product. Substantially fixed would allow a small amount of the film to move when the product is pushed. The preferred mode is to keep the film from moving. The sealing bar 8 seals and cuts the film so that a new curtain is created for the next product. Afterward the lower film roller pulls the film from the upper roll a few millimeters to allow for an unsealed sealed surface for cutting and sealing the next product on the dead plate. The lower film can be held stationary using pinch rollers. The position of upper roll film and the lower roll film can be interchanged.

To insure that the stroke of the pusher unwinds a predetermined length of film that coincides with the registration marks on the film, the length of the stroke is controlled by a sensor reading registration marks on the film. This is done by entering the length and width of the product in a computer. This will allow the computer to establish a minimum stroke which is smaller than the stroke needed from the pitch of the registration marks. When the machine is running a photo sensor reads the registration marks. If the registration mark is not read before the end of the stroke, the stroke of the pusher will be gradually increased until the registration mark coincides with the stroke of the pusher. If the registered mark is read before the end of the stroke, the stroke will be gradually decreased until the registration mark coincided with the stroke of the pusher. The stroke adjusts the position of the product with respect to the sealing bar thereby changing the length of the film used for wrapping. Tension of the film can be controlled by increasing the amount of film pulled by the lower waste film roller.

Figure 4:
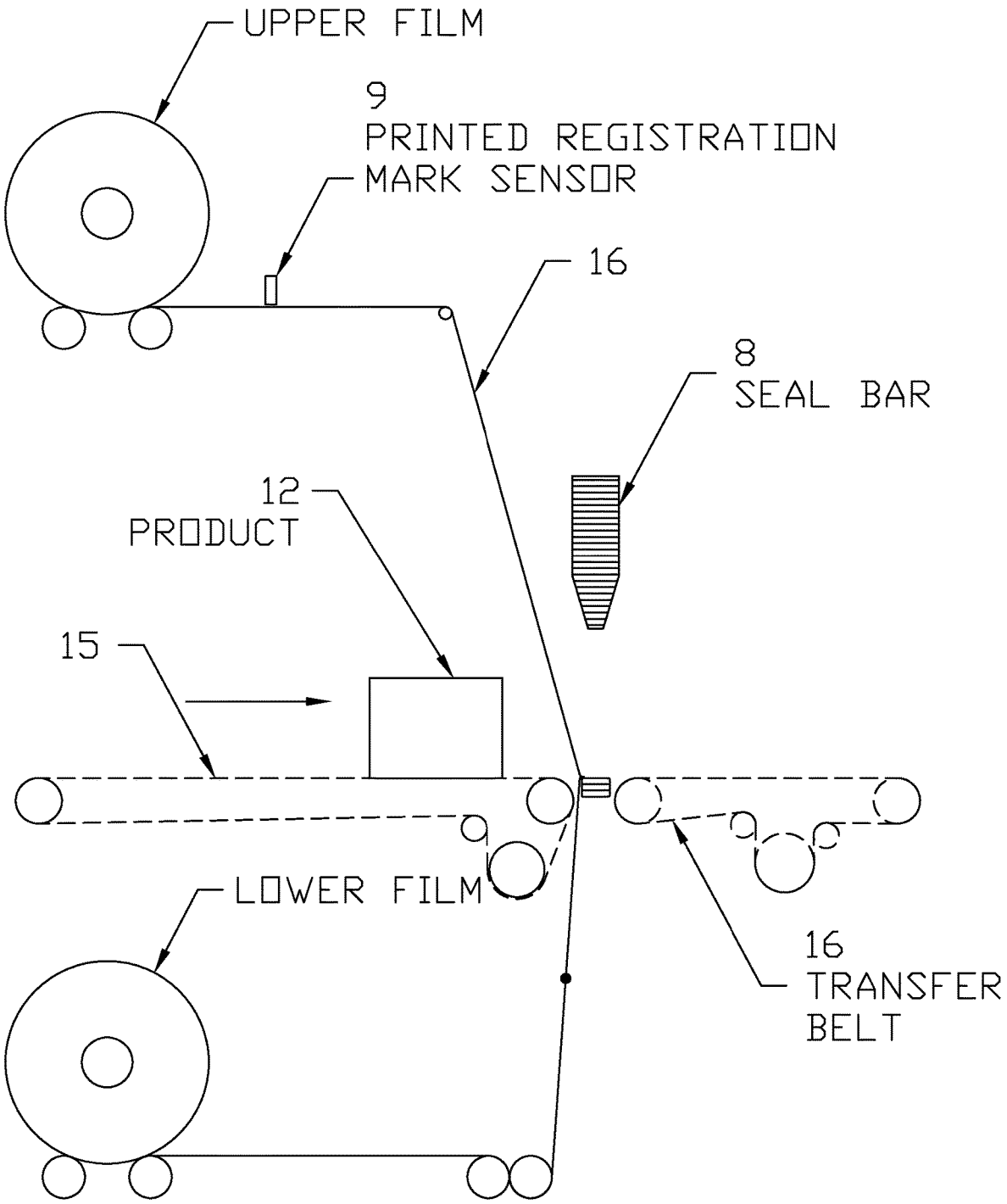
FIG. 4 shows pushing a product into a film curtain using a conveyor.

FIG. 4 shows product 12 on a conveyor being pushed on to conveyor 15 through a curtain of film 16 onto transfer belt. Lower film roll 17 is held in a stationary position while upper film roll allows the film to wrap the product. The film from the lower film roll is held under a tension by a dancing bar. As the product moves onto the transfer conveyor the dancing bar moves to allow more slack so that the film from the lower roll moves under the product. After sealing, the dancing bar moves to its original position. During the wrapping the length of film from the lower roll does not have to change during wrapping.

The photo sensor 9 reads a mark on the film that locates the position of the print registration. The sensing of the mark determines the where the product stops on the transfer belt before the sealing bar seals and cuts the curtain of film. If the sensor reading is to soon the product on the transfer belt will stops closer to the sealing bar. If the sensor reading is late, the product will stop further away from the sealing bar.

The invention claimed is:

1. An apparatus for wrapping a product with a heat shrinkable film from a single roll and for maintaining print registration comprising, a first roll having heat shrinkable film, a second roll having a film, means for pushing the product into a curtain of film while wrapping the product by unwinding the film from the first roll, while holding the film on the second roll in a substantially stationary position while wrapping the product from the film from the first roll, means for simultaneously cutting the film and sealing the film together on both sides of the cut thereby creating a film curtain, means for achieving print registration by adjusting the distance between the means for and cutting the film and where the product stops before sealing and cutting the film, means for pulling the film from the first roll after cutting and sealing the film, and means for sensing a registration mark on the film.

2. An apparatus according to claim 1 wherein the means for achieving print registration includes a pusher having a variable stroke that pushes the product resting on a dead plate through a film curtain onto another dead plate wherein the stroke of the pusher can vary the distance between the product and the seal bar before sealing.

3. An apparatus according to claim 1 wherein the means for pushing the product through a film curtain includes a conveyor that pushes the product through the film curtain onto a transfer conveyor.

4. An apparatus according to claim 3 wherein the means for achieving print registration includes means for varying the distance between the product on the transfer conveyor and the seal bar before sealing.

5. An apparatus according to claim 1 wherein the film from the second roll has a dancing bar that allows the film from the second roll to move under the product to reduce the tension during the transfer of the product from the conveyor to the transfer conveyor.

6. An apparatus according to claim 1 wherein the sensor means is a photo sensor.

7. A process for wrapping a product with a heat shrinkable film from a single roll comprising, providing a first roll of heat shrinkable film, providing a second roll having a film, pushing the product into a curtain of film while wrapping the product by unwinding the film from the first film while holding the second roll of film in a substantially stationary position while wrapping the product from the film from the first roll, adjusting the distance between the sealing bar and where the product stops before sealing and cutting the film to achieving print registration simultaneously cutting the film and sealing the film together on both sides of the cut thereby creating a film curtain pulling the film from the first roll after cutting and sealing the film, and sensing registration marks on the film.

8. A process according to claim 7 wherein the adjustment of the distance between the sealing bar and where the products stops before sealing and cutting the film includes pushing the product resting on a dead plate with a pusher having a variable stroke through a film curtain onto another dead plate wherein the stroke of the pusher establishes the distance between the product and the seal bar before sealing.

9. A process according to claim 7 wherein the product is pushed by a conveyor through a film curtain onto a transfer conveyor.

10. A process according to claim 7 including the steps of by entering the length and width of the product in a computer to establish a minimum stroke which is smaller than the stroke needed from the pitch of the registration marks.

11. An apparatus for wrapping a product with a heat shrinkable film from a single roll comprising;

a first roll having heat shrinkable film, a second roll having a film, means for pushing the product into a curtain of film while wrapping the product by unwinding the film from the first roll while holding the film on the second roll in a substantially stationary position while wrapping the product from the film from the first roll, means for achieving print registration by using a pusher with a variable stroke that pushes the product resting on a dead plate through a film curtain onto another dead plate where the stroke of the pusher establishes the distance between the product and the seal bar before sealing, means for simultaneously cutting the film and sealing the film together on both sides of the cut thereby creating a film curtain means for pulling the film from the first roll after cutting and sealing the film, and means for sensing a registration mark on the film.

* * * * *